US009048519B2

(12) United States Patent
Chen et al.

(10) Patent No.: US 9,048,519 B2
(45) Date of Patent: Jun. 2, 2015

(54) FILTER

(71) Applicant: HON HAI PRECISION INDUSTRY CO., LTD., New Taipei (TW)

(72) Inventors: Shyue-Dar Chen, New Taipei (TW); Chun-Jui Pan, New Taipei (TW); Hsiu-Kai Wen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/101,320

(22) Filed: Dec. 9, 2013

(65) Prior Publication Data

US 2015/0109075 A1 Apr. 23, 2015

(30) Foreign Application Priority Data

Oct. 22, 2013 (TW) ..... 102137999 A

(51) Int. Cl.

| | |
|---|---|
| ***H01P 1/20*** | (2006.01) |
| ***H01P 7/10*** | (2006.01) |
| ***H01P 7/00*** | (2006.01) |

(52) U.S. Cl.
CPC ..... *H01P 7/00* (2013.01)

(58) Field of Classification Search
USPC ..... 333/202, 203, 219.1, 242
See application file for complete search history.

(56) References Cited

U.S. PATENT DOCUMENTS

| | | | | |
|---|---|---|---|---|
| 6,175,286 | B1 * | 1/2001 | Ueno | 333/219.1 |
| 7,777,598 | B2 * | 8/2010 | Salehi et al. | 333/202 |

* cited by examiner

*Primary Examiner* — Hai L Nguyen
(74) *Attorney, Agent, or Firm* — Novak Druce Connolly Bove + Quigg LLP

(57) ABSTRACT

A filter includes a first printed circuit board (PCB), poles mounted on the first PCB, a second PCB located at a top of the first PCB, and caps mounted on the second PCB and covering the poles. Each the cap surrounds the corresponding pole. The cap and the pole cooperatively form a resonator. Each the first PCB and the second PCB is made of light, dielectric material with metallic layers.

14 Claims, 3 Drawing Sheets

FILTER

BACKGROUND

1. Technical Field

The present disclosure relates to a filter which is light.

2. Description of Related Art

A conventional high power filter includes a metallic bottom cover, a plurality of poles integrally extending from the bottom cover, and a metallic top cover engaging with the bottom cover and covering the poles. Each of the bottom cover and the top cover is formed by die casting. The top cover is aligned with the bottom cover. The top cover and the bottom cover are assembled by screws. Because the filter is made of metallic material, the filter is prone to be over weight. Therefore, the filter is difficult to carry and has a high cost.

What is needed, therefore, is an improved filter which overcomes the above described shortcomings.

DETAILED DESCRIPTION

An embodiment of a filter 100 in accordance with the present disclosure will now be described in detail below and with reference to the drawings.

Figure 1:
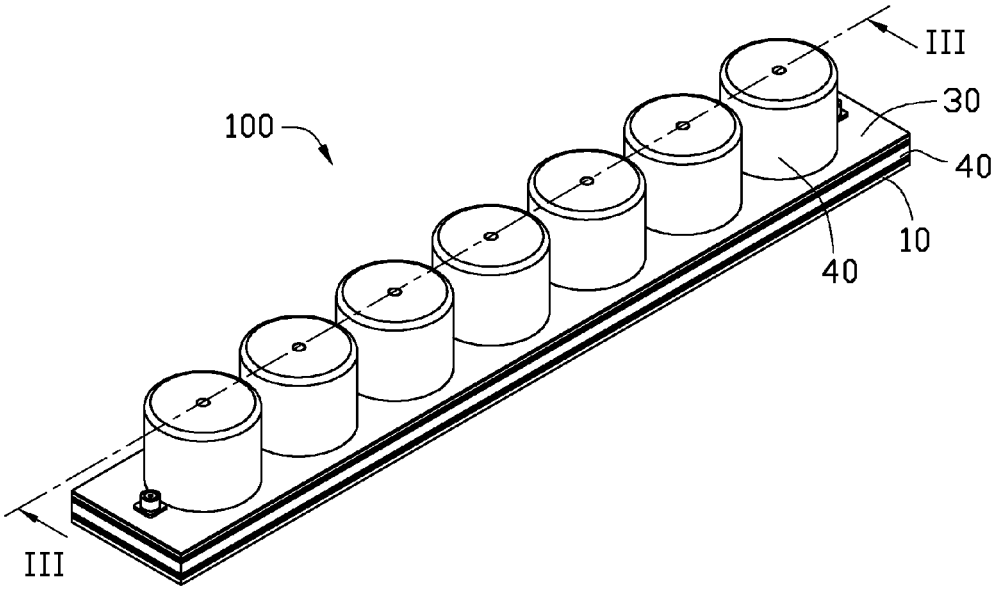
FIG. 1 is an assembled view of a filter of an exemplary embodiment of the present disclosure.

In the description that follows, the stated orientations of all of the elements of the filter 100 are with reference to the orientations of all of the elements as shown in FIG. 1.

Figure 2:
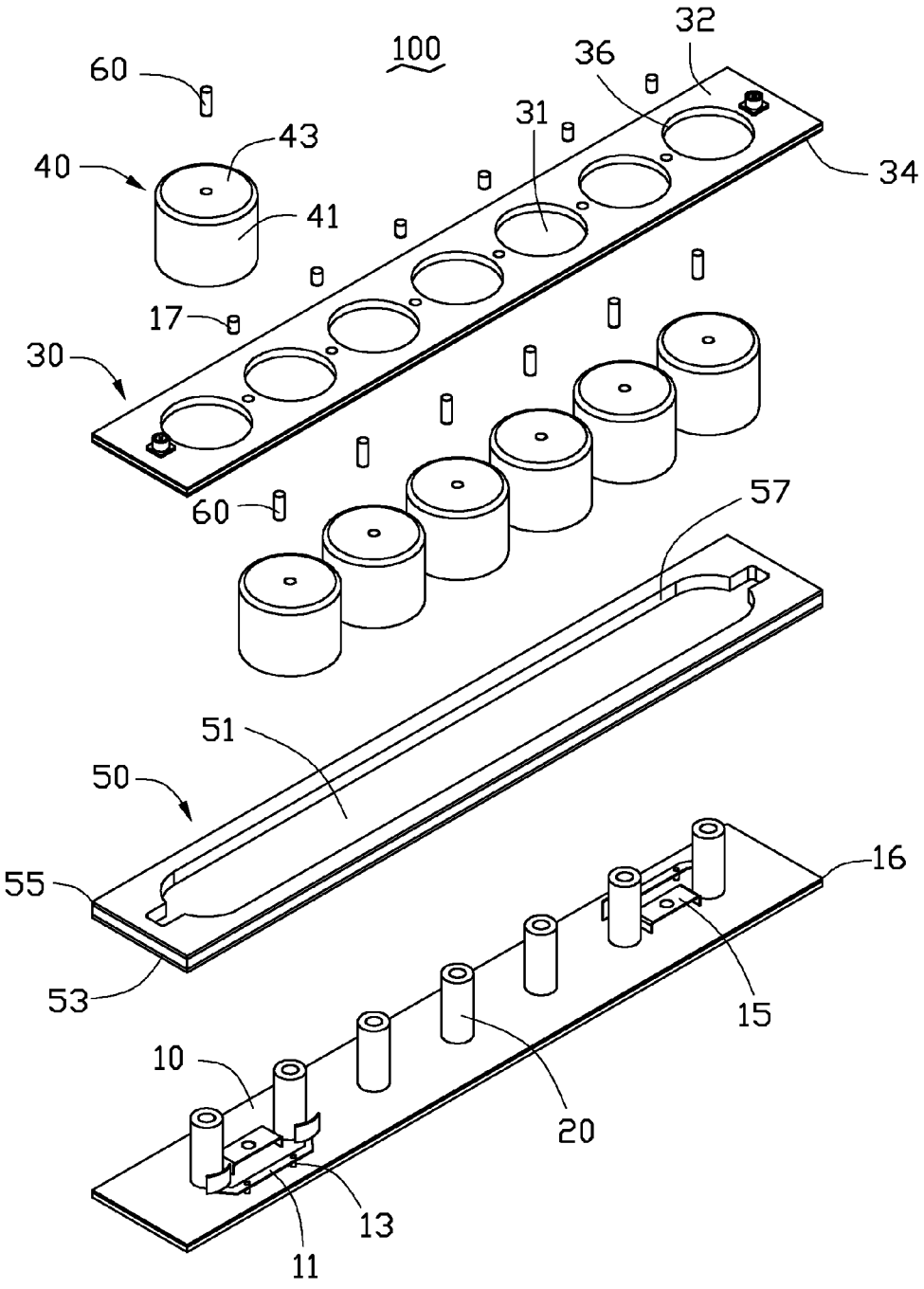
FIG. 2 is an exploded view of the filter of FIG. 1.

Referring to FIGS. 1 to 2, a filter 100 in accordance with an exemplary embodiment includes a first printed circuit board (PCB) 10, a plurality of poles 20 mounted on the first PCB 10, a second PCB 30 facing the first PCB 10, a plurality of caps 40 mounted on the second PCB 30 for covering the poles 20, and a third PCB 50 located between the first PCB 10 and the second PCB 30 to connect the first PCB 10 and the second PCB 30.

Each of the first PCB 10, the second PCB 30 and the third PCB 50 is made of light, dielectric material with metallic layers. In this embodiment, the light, dielectric material of each the first PCB 10, the second PCB 30, and the third PCB 50 is selected from wood pulp, or glass cloth impregnated with resin. Each of the first PCB 10, the second PCB 30, and the third PCB 50 is light and has a low cost.

The first PCB 10 is rectangular and includes a first metallic layer 16 formed on a top surface of the first PCB 10. The poles 20 are arranged along a longitudinal direction of the first PCB 10 and spaced from each other. Each of the poles 20 is a cylindrical, metallic pole and a top portion thereof is hollow. Top ends of the poles 20 are aligned with each other. Bottom ends of the poles 20 are soldered on the first metallic layer 16.

Two strips 11 and two loops 15 are mounted on the first PCB 10. Each of the strips 11 is located at lateral sides of two adjacent poles 20 and spaced from the corresponding poles 20. Each of the loops 15 is located between two adjacent poles 20. In this embodiment, the strips 11 are located at opposite ends of the first PCB 10. Opposite ends of each strip 11 are fixed to two electrically insulating posts 13 which extend upwardly from the first PCB 10 to make the strip 11 space from the first metallic layer 16. The opposite ends of each strip 11 are arc-shaped and surround outer surfaces of the corresponding poles 20. Opposite ends of each loop 15 are grounded and soldered on the first metallic layer 16.

The second PCB 30 is rectangular and a size thereof is equal to that of the first PCB 10. A plurality of through holes 31 is defined in the second PCB 30 along a longitudinal direction of the second PCB 30. The through holes 31 are aligned with the poles 20. A second metallic layer 32 and a third metallic layer 34 are respectively formed on a top surface and a bottom surface of the second PCB 30. A fourth metallic layer 36 is formed on an inner surface of each through hole 31.

Bottom ends of the caps 40 are soldered on the second metallic layer 32. Each cap 40 is a hollow cylinder with a top end thereof closed. The cap 40 includes an annular main body 41 and a disk-like shaped top plate 43 closed a top end of the main body 41. A bore diameter of the main body 41 is larger than that of the through hole 31. A central portion of the main body 41 is aligned with and communicates with the through hole 31.

The third PCB 50 is rectangular and a size thereof is equal to that of the first PCB 10. An elongated groove 51 is defined in a center of the third PCB along a longitudinal direction of the third PCB 50 to allow the poles 20 extending therethrough and function as a coupling cavity. The groove 51 may has different coupling value by changing a depth or a width of the groove 51. In this embodiment, a fifth metallic layer 55 and a sixth metallic layer 53 are respectively formed on a top surface and a bottom surface of the third PCB 50. A seventh metallic layer 57 is formed on an inner surface of the groove 51.

Figure 3:
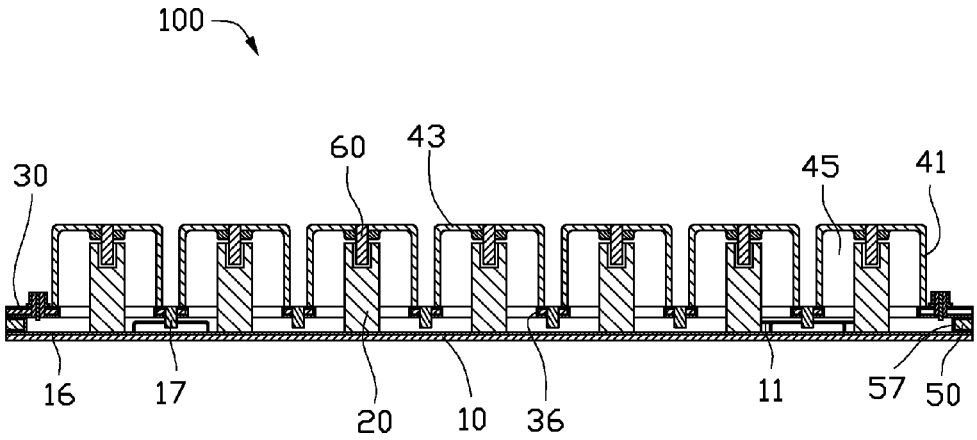
FIG. 3 is a cross sectional view of the filter of FIG. 1.

Referring to FIG. 3, when the filter 100 is assembled, the first PCB 10 and the second PCB 30 are arranged on opposite sides of the third PCB 50. The first PCB 10, the second PCB 30 and the third PCB 50 are screwed. In this state, the poles 20 extend through the groove 51, the through holes 31 and are received in the caps 40. The strips 11 and the loops 15 are received in the groove 51. Each cap 40 and the corresponding pole 20 cooperatively form a resonator 45. The cap 40 surrounds and is spaced from the pole 20. The resonators 45 communicate with each other through the groove 51.

The strip 11 makes two the corresponding resonators 45, which have two poles 20 couple with the strip 11, be coupled. When a length of the strip 11 is less than $\lambda/2$, it'll provide capacitive coupling between the two corresponding resonators 45. When the length of the strip 11 is varied between $\lambda/2$ and $\lambda$, it'll provide inductive coupling between the two corresponding resonators 45. When the length of the strip 11 is varied between $\lambda$ and $3\lambda/2$, it'll provide capacitive coupling between the two corresponding resonators 45. When the length of the strip 11 is varied according to the aforesaid rules, the coupling types between the resonators 45 are also changed according to the aforesaid rules.

The loop 15 makes two the corresponding resonators 45 be coupled. When a length of the loop 15 is less than $\lambda/2$, it'll provide inductive coupling between the two corresponding resonators 45. When the length of the loop 15 is varied between $\lambda/2$ and $\lambda$, it'll provide capacitive coupling between the two corresponding resonators 45. When the length of the loop 15 is varied between $\lambda$ and $3\lambda/2$, it'll provide inductive coupling between the two corresponding resonators 45. When the length of the loop 15 is varied according to the aforesaid rules, the coupling types between the corresponding resonators 45 are also changed according to the aforesaid rules. When the loop 15 is aligned with the two corresponding poles 20, the coupled value of the resonators 45 is the largest.

A first tuning screw 60 is arranged between the pole 20 and the cap 40. A bottom end of the first tuning screw 60 is received in the top portion of the pole 20, and a top end of the first tuning screw 60 extends through the top plate 43. The first tuning screw 60 is adjusted to adjust a distance between the top plate 43 and the top end of the pole 20 to control a frequency of the resonator 45. A plurality of second tuning screws 17 extend through the second PCB 30 and bottom ends thereof are received in the groove 51. The second tuning screws 17 are adjusted to change a coupling value between the resonator 45.

In this disclosure, because each of the first PCB 10, the second PCB 30 and the third PCB 50 is made of light, dielectric material with metallic layers, the weight of the filter 100 is decreased related to the conventional filter. Therefore, the filter 100 may be carried expediently and the cost of the filter 100 is decreased.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A filter comprising:

a first printed circuit board (PCB);

a plurality of poles mounted on the first PCB;

a second PCB located at a top of the first PCB; and a plurality of caps mounted on the second PCB and covering the poles;

wherein each the cap surrounds the corresponding pole, the cap and the pole cooperatively form a resonator, and each the first PCB and the second PCB is made of light, dielectric material with metallic layers.

2. The filter of claim 1, wherein the light, dielectric material of each the first PCB and the second PCB is selected from wood pulp, or glass cloth impregnated with resin.

3. The filter of claim 2, wherein a first metallic layer is formed on a top surface of the first PCB.

4. The filter of claim 3, wherein a loop is located between two poles and opposite ends of the loop are mounted on the first metallic layer.

5. The filter of claim 3, wherein a strip is located at lateral sides of two poles and make two the resonators having the corresponding poles be coupled.

6. The filter of claim 5, wherein two electrically insulating posts extend from the first PCB and support the strip to make the strip be fixed thereto and spaced from the first PCB.

7. The filter of claim 5, wherein opposite ends of the strip are arc-shaped and surround outer surfaces of the corresponding poles.

8. The filter of claim 1, wherein a plurality of through holes is defined in the second PCB, and the caps are aligned with and communicate with the through holes.

9. The filter of claim 1, wherein a second metallic layer is formed on a top surface of the second PCB, a third metallic layer is formed on a bottom surface of the second PCB, and a fourth metallic layer is formed on an inner surface of the through hole.

10. The filter of claim 1, wherein a first tuning screw is arranged between the pole and the cap, a bottom end of the first tuning screw is received in a top portion of the pole, and a top end of the first tuning screw extends the cap.

11. The filter of claim 1, wherein a third PCB is located between the first PCB and the second PCB and connects the first PCB and the second PCB.

12. The filter of claim 11, wherein a groove is defined in the third PCB, the poles extend through the groove and are received in the caps, and the resonators communicate with each other from the groove.

13. The filter of claim 12, wherein a second tuning screw extends through the second PCB and a bottom end of the second tuning screw is received in the groove.

14. The filter of claim 13, wherein a fifth metallic layer and a sixth metallic layer are respectively formed on a top surface and a bottom surface of the third PCB, and a seventh metallic layer is formed on an inner surface of the groove.

* * * * *